US012778300B2

(12) United States Patent
Jin et al.

(10) Patent No.: US 12,778,300 B2
(45) Date of Patent: Nov. 3, 2026

(54) MECHANICAL EXTENDING DEVICE FOR SEAT

(71) Applicant: EMOMO TECH (ZHEJIANG) CO., LTD, Huzhou (CN)

(72) Inventors: Kai Jin, Huzhou (CN); Chenkai Fu, Huzhou (CN); Yushu Zhao, Huzhou (CN)

(73) Assignee: EMOMO TECH (ZHEJIANG) CO., LTD, Huzhou (CN)

( * ) Notice: Subject to any disclaimer, the term of this patent is extended or adjusted under 35 U.S.C. 154(b) by 90 days.

(21) Appl. No.: 19/006,947

(22) Filed: Dec. 31, 2024

(65) Prior Publication Data

US 2026/0137213 A1 May 21, 2026

Related U.S. Application Data

(63) Continuation of application No. PCT/CN2024/143597, filed on Dec. 30, 2024.

(30) Foreign Application Priority Data

Nov. 21, 2024 (CN) ..... 202422847681.7

(51) Int. Cl.
*A47C 1/034* (2006.01)

(52) U.S. Cl.
CPC ..... *A47C 1/0345* (2013.01)

(58) Field of Classification Search
CPC ..... A47C 1/0345
See application file for complete search history.

(56) References Cited

U.S. PATENT DOCUMENTS

2026/0137213 A1* 5/2026 Jin ..... A47C 1/0345

* cited by examiner

*Primary Examiner* — Jonathan Liu
(74) *Attorney, Agent, or Firm* — HOWARD M COHN and Associates, LLC

(57) ABSTRACT

In a mechanical extending device of a seat, a seat mounting plate limiting structure, a backrest hinge shaft, and a first connection rod hinge shaft are arranged on a seat mounting plate; a leg assembly is mounted to a front of the seat mounting plate; a rear upper end of the seat mounting plate is hingedly connected to the backrest mounting rod. The backrest mounting rod, the backrest support rod, the first connection rod, the seat mounting plate, the third connection rod, the second connection rod, the leg assembly are hingedly connected to each other. The second connection rod is arranged with a first support to support a load on the front of the seat mounting plate at a sitting position and a TV position. A second support is arranged on the third connection rod and is limited by a second support mounting groove of the fixing plate.

5 Claims, 3 Drawing Sheets

MECHANICAL EXTENDING DEVICE FOR SEAT

TECHNICAL FIELD

The present disclosure relates to a technical field of mechanical extending devices for seats, and more specifically, to a mechanical extending device for a seat.

BACKGROUND

The related art of the present disclosure refers to a Chinese patent publication No. CN209121640U, in the title of "ELECTRIC SOFA LINKAGE DEVICE". A major defect in the related art is that a sofa cushion is mounted on a cushion mounting member 2, and springs are arranged inside the sofa cushion. When a push rod motor 63 drives a push rod 62 to move forwardly, a hinged point between a rotation push rod 52 and a lower fixing member 53 protrudes upwardly to be higher than an upper plane of the cushion mounting member 2. In this case, the hinged point of the rotation push rod 52 and the lower fixing member 53 pushes against the sofa cushion, causing damages to the sofa cushion.

SUMMARY

The present disclosure provides a mechanical extending device for a seat that is operated manually to prevent any damage to the sofa cushion.

The present disclosure provides a mechanical extending device of a seat, including: a seat mounting plate, a backrest mounting rod, a backrest support rod, a fixing plate, a first connection rod, a second connection rod, a third connection rod, and a leg assembly. A seat mounting plate limiting structure, a backrest hinge shaft, and a first connection rod hinge shaft are arranged on the seat mounting plate; a leg assembly is mounted to a front portion of the seat mounting plate; a rear upper end of the seat mounting plate is hingedly connected to the backrest mounting rod; the backrest mounting rod is hingedly connected, via a backrest adjustment shaft, to an end of the backrest support rod; the other end of the backrest support rod is mounted to the fixing plate. An end of the first connection rod is hingedly connected to the seat mounting plate, the other end of the first connection rod is hingedly connected to an end of the third connection rod; the other end of the third connection rod is hingedly connected, via a third connection rod mounting shaft, to the fixing plate; an end of the second connection rod is hingedly connected, via a second connection rod mounting shaft, to the fixing plate; the other end of the second connection rod is hingedly connected, via a leg assembly drive shaft, to the leg assembly. The second connection rod is arranged with a first support and is engaged with the fixing plate; the first support is configured to support a load on the front portion of the seat mounting plate when the mechanical extending device is at a sitting position and in a TV position; a second support is arranged at a middle portion of the third connection rod, and the second support is received in a second support mounting groove of the fixing plate; the seat mounting plate limiting structure and the first connection rod are cooperatively configured to support a load on a rear portion of the seat mounting plate when the mechanical extending device is in the TV position and in a lay-down position.

In some embodiments, the backrest mounting rod is further arranged with a backrest limiting structure; the backrest limiting structure cooperates with an Ω-shaped support edge of the backrest support rod.

In some embodiments, the first connection rod is L-shaped; and when the mechanical extending device is in the TV position and in the lay-down position, a connection line from a center point of the seat mounting plate limit to a center point of a third connection rod hinge shaft is located substantially at a middle of a vertical section of the L-shaped first connection rod.

In some embodiments, the leg assembly comprises a first leg connection rod, a second leg connection rod, a third leg connection rod, a fourth leg connection rod, a fifth leg connection rod, a sixth leg connection rod, and a footrest mounting member. An end of the first leg connection rod and an end of the second leg connection rod are hingedly connected to the seat mounting plate; the other end of the first leg connection rod is hingedly connected to an end of the third leg connection rod; the other end of the third leg connection rod is hingedly connected to an end of the footrest mounting member; the other end of the third leg connection rod is hingedly connected to an end of the footrest mounting member; the other end of the footrest mounting member is hingedly connected to an end of the sixth leg connection rod; the other end of the sixth leg connection rod is hingedly connected to an end of the fifth leg connection rod; a middle portion of the fifth leg connection rod is hingedly connected to a middle portion of the third leg connection rod; the other end of the fifth leg connection rod is hingedly connected to an end of the fourth leg connection rod; a middle portion of the fourth leg connection rod is hingedly connected to a middle portion of the first leg connection rod; the other end of the fourth leg connection rod is hingedly connected to the second leg connection rod; the fourth leg connection rod is arranged with a leg assembly limiting structure; a middle portion of the second leg connection rod is hingedly connected, via a leg assembly drive shaft, to the second connection rod.

In some embodiments, the second support mounting groove is a rectangular-rounded groove, and a length direction of the second support mounting groove is substantially perpendicular to an extending direction of the fixing plate.

In the present disclosure, damages to a sofa cushion caused by hinge structures can be avoided.

Figure 1:
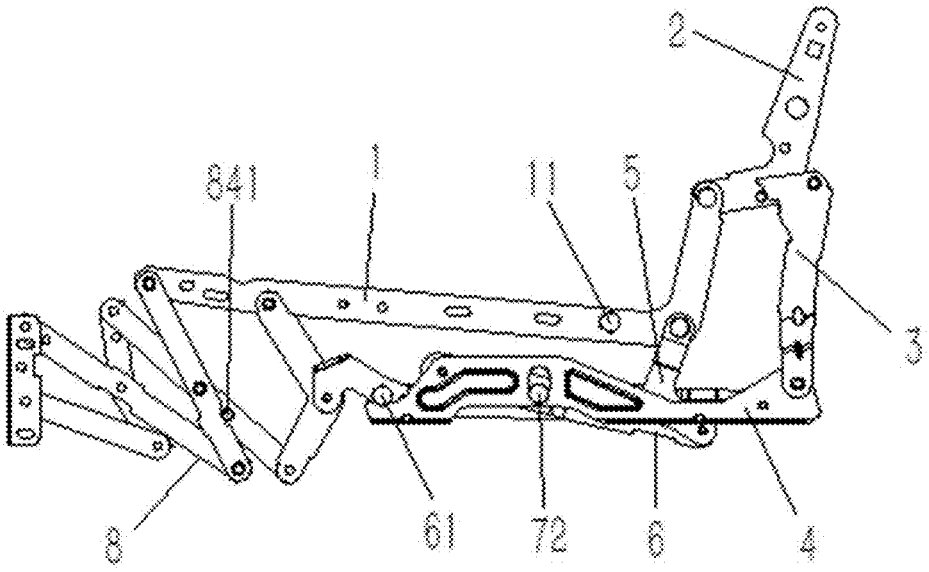
FIG. 1 is an inner side plane view of a mechanical extending device for a seat in a sitting position according to an embodiment of the present disclosure.

Reference numerals in the drawings:

1, seat mounting plate; 11, limiting structure of the seat mounting plate; 12, backrest hinge shaft; 13, first connection rod hinge shaft; 2, backrest mounting rod; 21, backrest limiting structure; 22, backrest adjustment shaft; 3, backrest support rod; 31, Ω-shaped support edge; 4, fixing plate; 41, second support mounting slot; 42, third connection rod mounting shaft; 43, second connection rod mounting shaft; 5, first connection rod; 6, second connection rod; 61, first support; 62, leg assembly drive shaft; 7, third connection rod; 71, third connection rod hinge shaft; 72, second support; 8, leg assembly; 81, first leg connection rod; 82, second leg connection rod; 83, third leg connection rod; 84, fourth leg connection rod; 841, leg assembly limiting structure; 85, fifth leg connection rod; 86, sixth leg connection rod; and 87, footrest plate mounting member.

DETAILED DESCRIPTIONS

The present disclosure is described in further detail below by referring to the accompanying drawings and embodiments, the following embodiments are explanatory of the present disclosure, and the present disclosure is not limited to the following embodiments. In FIG. 1, a left side of the drawing is a front of a device, and a right side of the drawing is a rear of the device.

As shown in FIGS. 1 to 5, embodiments of the present disclosure provide a mechanical extending device of a seat, and the mechanical extending device includes: a seat mounting plate 1, a backrest mounting rod 2, a backrest support rod 3, a fixing plate 4, a first connection rod 5, a second connection rod 6, a third connection rod 7, and a leg assembly 8. A seat mounting plate limiting structure 11, a backrest hinge shaft 12, and a first connection rod hinge shaft 13 are arranged on the seat mounting plate 1. A leg assembly 8 is mounted to a front portion of the seat mounting plate 1. A rear upper end of the seat mounting plate 1 is hingedly connected to the backrest mounting rod 2. The backrest mounting rod 2 is hingedly connected, via a backrest adjustment shaft 22, to an end of the backrest support rod 3. The other end of the backrest support rod 3 is mounted to the fixing plate 4. An end of the first connection rod 5 is hingedly connected to the seat mounting plate 1, and the other end of the first connection rod 5 is hingedly connected to an end of the third connection rod 7. The other end of the third connection rod 7 is hingedly connected, via a third connection rod mounting shaft 42, to the fixing plate 4. An end of the second connection rod 6 is hingedly connected, via a second connection rod mounting shaft 43, to the fixing plate 4. The other end of the second connection rod 6 is hingedly connected, via a leg assembly drive shaft 63, to the leg assembly 8. The second connection rod 6 is arranged with a first support 61 and is engaged with the fixing plate 4. The first support 61 is configured to support a load on the front portion of the seat mounting plate 1 when the mechanical extending device is at a sitting position and in a TV position. A second support 72 is arranged at a middle portion of the third connection rod 7, and the second support 72 is received in a second support mounting groove 41 of the fixing plate 4. The second support mounting groove 41 is a rectangular-rounded groove, and a length direction of the second support mounting groove 41 is substantially perpendicular to an extending direction of the fixing plate 4. When the mechanical extending device is at a lay-down position, receiving the second support 72 in the second support mounting groove 41 limits relative positions of the third connection rod 7, the first connection rod 5, and a rear portion of the seat mounting plate 1. The seat mounting plate limiting structure 11 and the first connection rod 5 cooperatively support a load on the rear portion of the seat mounting plate when the mechanical extending device is in the TV position and in the lay-down position.

In the present disclosure, the backrest mounting rod 2 is further arranged with a backrest limiting structure 21. The backrest limiting structure 21 cooperates with an Ω-shaped support edge 31 of the backrest support rod 3. During a position of the mechanical extending device being changed, the backrest limiting structure 21 always attaches the Ω-shaped support edge 31, assisting in locating a relative position of the backrest mounting rod 2 and the backrest support rod 3.

In the present disclosure, the first connection rod 5 is L-shaped. When the mechanical extending device is in the TV position and in the lay-down position, a connection line from a center point of the seat mounting plate limit 11 to a center point of a third connection rod hinge shaft 71 is located substantially at a middle of a vertical section of the L-shaped first connection rod. In this way, the load on the rear portion of the seat mounting plate 1 can be supported.

Two mechanical extending devices of the present disclosure are mounted on a seat frame and are symmetrically disposed to each other, and a footrest plate is arranged. In this way, a position-adjustable seat, such as a trolley chair, is formed.

The leg assembly includes a first leg connection rod 81, a second leg connection rod 82, a third leg connection rod 83, a fourth leg connection rod 84, a fifth leg connection rod 85, a sixth leg connection rod 86, and a footrest mounting member 87. An end of the first leg connection rod 81 and an end of the second leg connection rod 82 are hingedly connected to the seat mounting plate 1. The other end of the first leg connection rod 81 is hingedly connected to an end of the third leg connection rod 83. The other end of the third leg connection rod 83 is hingedly connected to an end of the footrest mounting member 87. The other end of the third leg connection rod 83 is hingedly connected to an end of the footrest mounting member 87. The other end of the footrest mounting member 87 is hingedly connected to an end of the sixth leg connection rod 86. The other end of the sixth leg connection rod 86 is hingedly connected to an end of the fifth leg connection rod. A middle portion of the fifth leg connection rod 85 is hingedly connected to a middle portion of the third leg connection rod 83. The other end of the fifth leg connection rod 85 is hingedly connected to an end of the fourth leg connection rod 84. A middle portion of the fourth leg connection rod 84 is hingedly connected to a middle portion of the first leg connection rod 81. The other end of the fourth leg connection rod 84 is hingedly connected to the second leg connection rod 82. The fourth leg connection rod 84 is arranged with a leg assembly limiting structure 841. A middle portion of the second leg connection rod 82 is hingedly connected, via a leg assembly drive shaft 62, to the second connection rod 6.

The mechanical extending device of the seat in the present disclosure operates as follows.

Figure 2:
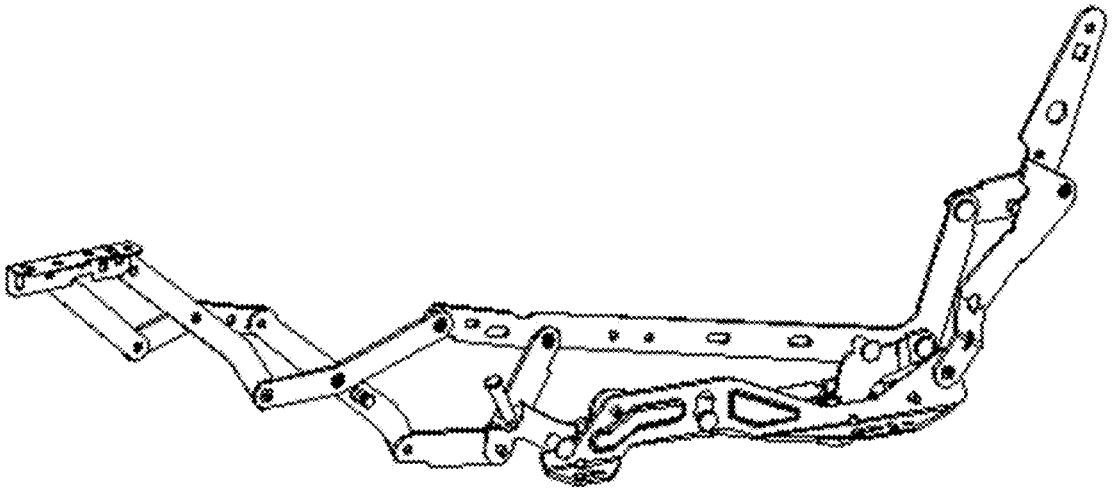
FIG. 2 is a perspective view of the mechanical extending device for the seat in a TV position according to an embodiment of the present disclosure.
Figure 3:
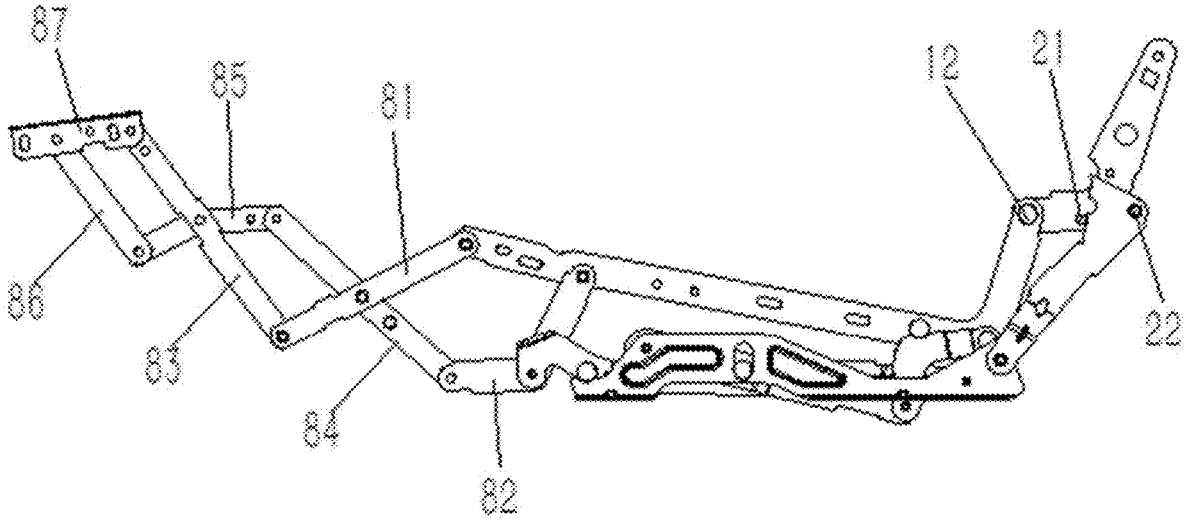
FIG. 3 is an inner side plane view of the mechanical extending device for the seat in the TV position according to an embodiment of the present disclosure.
Figure 4:
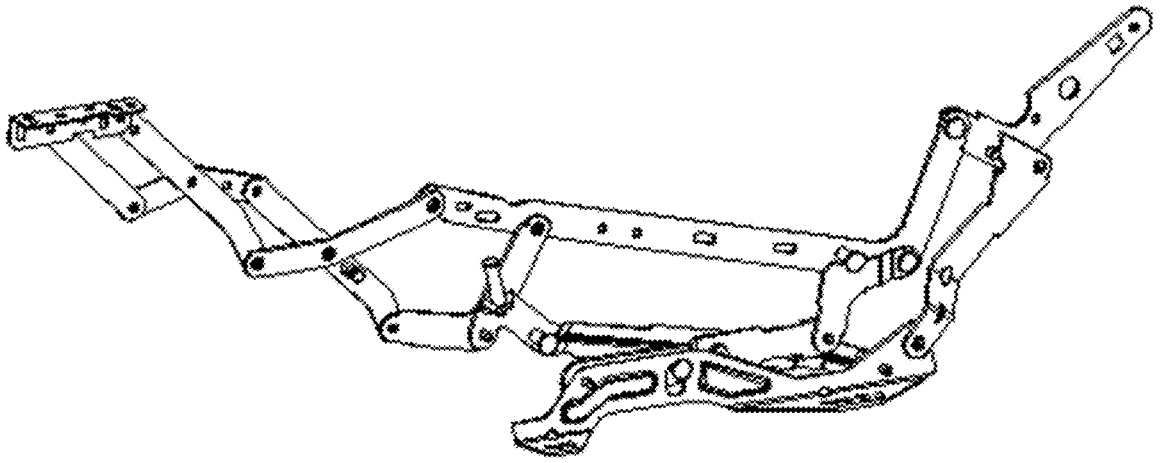
FIG. 4 is a perspective view of the mechanical extending device for the seat in a lay-down position according to an embodiment of the present disclosure.
Figure 5:
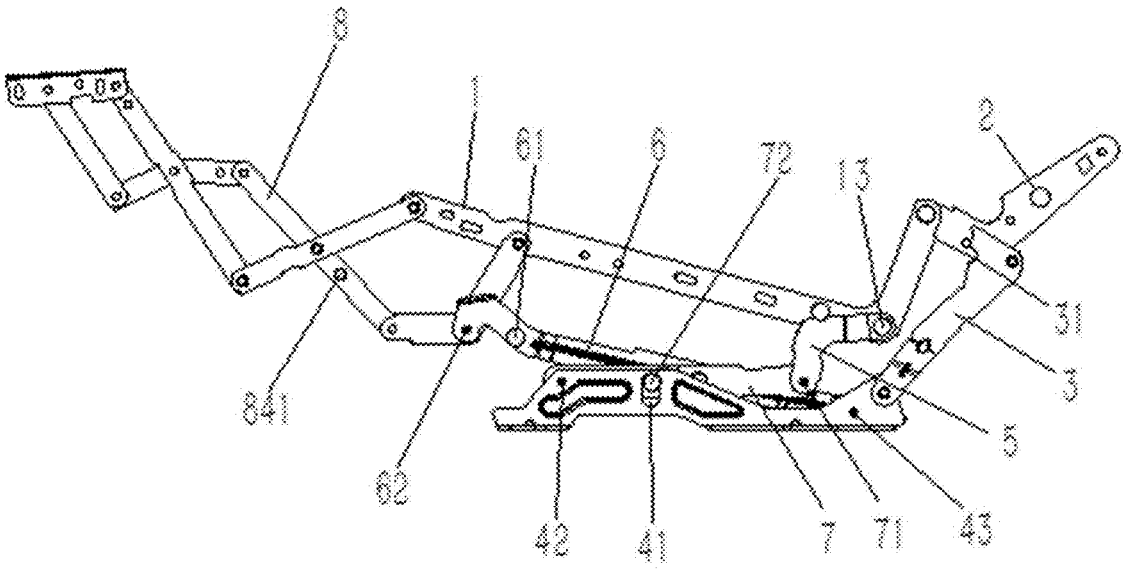
FIG. 5 is an inner side plane view of the mechanical extending device for the seat in the lay-down position according to an embodiment of the present disclosure.

In the sitting position, when a user desires to adjust to the TV position, the user only needs to push armrests (not shown in the drawings, the armrests are mounted on the fixing plate 4) with two hands and lean a body backward. In this way, the seat mounting plate 1 is enabled to move backward until the seat mounting plate limiting structure 11 is in contact with the first connection rod 5 and is located at an upper front of the first connection rod 5, such that the mechanical extending device enters the TV position, as shown in FIGS. 1 to 3. When the user desires to adjust form the TV position to the lay-down position, the user leans a back towards an upper of the backrest mounting rod 2, enabling the backrest mounting rod 2 to be tilted backward and downward around the backrest hinge shaft 12. In this way, the seat mounting plate 1 is moved backward and upward until the second support 72 is moved upwardly to reach an upper part of the second support mounting groove 41. When the second support 72 reaches the upper part of the second support mounting groove 41, the second support 72 cannot move further. In this way, the mechanical extending device enters the lay-down position, as shown in FIG. 5. When the mechanical extending device needs to return to the TV position from the lay-down position, the user only needs to use the two hands to hold the armrests and release a pressure on the backrest mounting rod 2, a body pressure causes the seat mounting plate 1, the second connection rod 6, and a rear portion of the third connection rod 7 to move downwardly until the second support 72 is located at a lower part of the second support mounting groove 41 to support the second connection rod 6. In this way, the mechanical extending device is reset to the TV position. When the mechanical extending device is reset from the TV position to the sitting position, feet of the user hook the footrest mounting member 87, and the two hands hold on the armrests to provide support. In this way, the leg assembly 8 is driven to retract until the leg assembly limiting structure 841 touches the first leg connection rod 81, such that the mechanical extending device is reset to the sitting position. Accordingly, in practice, hinge structures are prevented from pressing against a sofa cushion, damages to the sofa cushion caused by the hinge structures can be avoided.

Technical contents not described in detail in the present disclosure are available in the related art.

What is claimed is:

1. A mechanical extending device of a seat, comprising: a seat mounting plate, a backrest mounting rod, a backrest support rod, a fixing plate, a first connection rod, a second connection rod, a third connection rod, and a leg assembly;

wherein a seat mounting plate limiting structure, a backrest hinge shaft, and a first connection rod hinge shaft are arranged on the seat mounting plate; the leg assembly is mounted to a front portion of the seat mounting plate; a rear upper end of the seat mounting plate is hingedly connected to the backrest mounting rod; the backrest mounting rod is hingedly connected, via a backrest adjustment shaft, to an end of the backrest support rod; the other end of the backrest support rod is mounted to the fixing plate;

an end of the first connection rod is hingedly connected to the seat mounting plate, the other end of the first connection rod is hingedly connected to an end of the third connection rod; the other end of the third connection rod is hingedly connected, via a third connection rod mounting shaft, to the fixing plate; an end of the second connection rod is hingedly connected, via a second connection rod mounting shaft, to the fixing plate; the other end of the second connection rod is hingedly connected, via a leg assembly drive shaft, to the leg assembly;

the second connection rod is arranged with a first support and is engaged with the fixing plate; the first support is configured to support a load on the front portion of the seat mounting plate when the mechanical extending device is at a sitting position and in a TV position; a second support is arranged at a middle portion of the third connection rod, and the second support is received in a second support mounting groove of the fixing plate; the seat mounting plate limiting structure and the first connection rod are cooperatively configured to support a load on a rear portion of the seat mounting plate when the mechanical extending device is in the TV position and in a lay-down position.

2. The mechanical extending device according to claim 1, wherein the backrest mounting rod is further arranged with a backrest limiting structure; the backrest limiting structure cooperates with a support edge of the backrest support rod.

3. The mechanical extending device according to claim 2, wherein the first connection rod is L-shaped; and when the mechanical extending device is in the TV position and in the lay-down position, a connection line from a center point of the seat mounting plate limiting structure to a center point of a third connection rod hinge shaft is located substantially at a middle of a vertical section of the L-shaped first connection rod.

4. The mechanical extending device according to claim 1, wherein the leg assembly comprises a first leg connection rod, a second leg connection rod, a third leg connection rod, a fourth leg connection rod, a fifth leg connection rod, a sixth leg connection rod, and a footrest mounting member;

an end of the first leg connection rod and an end of the second leg connection rod are hingedly connected to the seat mounting plate; the other end of the first leg connection rod is hingedly connected to an end of the third leg connection rod; the other end of the third leg connection rod is hingedly connected to an end of the footrest mounting member; the other end of the third leg connection rod is hingedly connected to an end of the footrest mounting member;

the other end of the footrest mounting member is hingedly connected to an end of the sixth leg connection rod; the other end of the sixth leg connection rod is hingedly connected to an end of the fifth leg connection rod; a middle portion of the fifth leg connection rod is hingedly connected to a middle portion of the third leg connection rod; the other end of the fifth leg connection rod is hingedly connected to an end of the fourth leg connection rod; a middle portion of the fourth leg connection rod is hingedly connected to a middle portion of the first leg connection rod; the other end of the fourth leg connection rod is hingedly connected to the second leg connection rod; a leg assembly limiting structure is disposed on the fourth leg connection rod; a middle portion of the second leg connection rod is hingedly connected, via the leg assembly drive shaft, to the second connection rod.

5. The mechanical extending device according to claim 1, wherein the second support mounting groove is a rectangular-rounded groove, and a length direction of the second support mounting groove is substantially perpendicular to an extending direction of the fixing plate.

* * * * *